United States Patent [19]

Mueller, III

[11] Patent Number: 4,613,012

[45] Date of Patent: Sep. 23, 1986

[54] ARTICLE OF ROLLED FORM

[75] Inventor: John B. Mueller, III, Newark, Ohio

[73] Assignee: The Little Screamer Group Limited, Mansfield, Ohio

[21] Appl. No.: 728,573

[22] Filed: Apr. 29, 1985

[51] Int. Cl.[4] ..... G10K 11/00

[52] U.S. Cl. ..... 181/178

[58] Field of Search ..... 181/177, 178

[56] References Cited

U.S. PATENT DOCUMENTS 936,910 10/1909 Kingsley ..... 181/178

1,158,871 11/1915 Tomlin ..... 181/178 X 2,507,843 5/1950 Wheeler ..... 181/178 X 2,517,665 8/1950 Hochstein ..... 181/178

*Primary Examiner*—Benjamin R. Fuller

*Attorney, Agent, or Firm*—Robert B. Watkins

[57] ABSTRACT

An article of rolled form constructed of card-like semi-rigid flexible material assembled by rolled assembly to form an article of annular cross sectional shape. The article is preferrably a megaphone with the advantages of having a complimentary handle comprised of a double thickness of the card-like material and additional tabs placed to add rigidity and maintain circular shape.

6 Claims, 6 Drawing Figures

ARTICLE OF ROLLED FORM

FIELD OF THE INVENTION

This invention relates to an article that is formed by rolling a plyable planar material into a generally tubular shape having circular or annular cross section. More particulary it relates to such an article of rolled form which tapers from one end to the other constituting a megaophone for sound amplication.

BACKGROUND OF THE INVENTION

Articles that are made of rolled form and construction from planar flexible material are well known and have been provided from various materials such as paper, impregnated cardboard, sheetmetal, and in recent years plastics such as polyethylene and vinyl sheets. Such rolled articles have various uses including the use as a megaphone.

The megaphone is a well known aid to voice amplification device often used by partisan spectators to enhance the volume of their cheers. The prior art discloses its first version shortly after the advent of team sports around the turn of the twentieth century. Many articles of rolled form are permanently manufactured in the rolled form and sold as such. On the other hand, others are manufactured and sold in the flat or unassembled condition, having means provided to assemble the article in situ at the place of use. Previous inventions have been made in megaphones of this later type.

U.S. Pat. No. 1,158,871 to Tomlin shows a megaphone having radical edges and arcuate ends and provided with slits and tabs to hold the article in assembled condition. Changes have been few and have delt primarily with methods of attaching the two edges more securely. U.S. Pat. No. 1,158,871—Tomlin is an example of this. U.S. Pat. No. 2,517,665—Hochstein is another example with a foldable handle. Because of the nature of the paper material, these devices tended to be limited in durability and were chiefly for advertising promotions and given away at no charge to the local citizenry.

Additionally, the nature of the folding process tended to produce an oval shaped horn. Recently, newer materials with greater durability have been developed, making it possible to create a more permanent megaphone. A megaphone having this characteristic should have an improved design producing a sturdy and lasting interlocking mechanism as well as a consistently more circular shape.

SUMMARY OF THE INVENTION

This invention relates to articles of rolled form constructed of pliable materials. Articles commonly known as megaphones are an important example. This invention is directed more particularly to an inexpensive implementation made from a single sheet or blank of flexible material. More specifically, the device of this invention in the unassembled condition is a planar cardlike semirigid flexible material having an arcuate shape with opposite and opposing ends, and opposite and opposing edges, with at least one slit near one edge and at least one tab near the other edge, and one or more other tabs on each end.

In the assembled condition of this invention, the megaphone effect is achieved through a rolled construction creating a circular cross sectional shape between the ends with the edges overlapped and the at least one tab engaged in the at least one slit to retain the article in the assembled condition. The one or more other tab on each end is inserted within the roll of the other end to restrain the article in the generally circular cross sectional shape. In this assembled condition, the juxtaposed edges have complementary handle means cut from the material element in the unassembled condition and folded to laterally protrude from a side of the article in the assembled condition. In order to maintain the circular cross sectional shape, the one or more other tabs on each end comprises one or more tabs parallel to the shape of the end, situated at the intersection of the end and an edge, in the unassembled condition, and comprises a rolled circular portion conforming to the circular cross sectional form of the end, in the assembled condition.

In the practice and use of the device of this invention, indicia of novelty or display significance is imprinted upon at least one side of the material means in the unassembled condition, and the indicia is legibly visable from the outside of the article in the assembled condition.

It is a purpose of this invention to provide a more lasting megaphone of structurally sound design more appropriate for recently developed plastic materials having a more permanent complimentary handle means as well as a more circular horn shape.

The foregoing and other advantages of the invention will become apparent from the following disclosure in which a preferred embodiment of the invention is described in detail and illustrated in the accompanying drawings. It is contemplated that variations in procedures, structural features and arrangement of parts may appear to the person skilled in the art without departing from the scope or sacrificing any of the advantages of the invention.

DETAILED DESCRIPTION OF THE INVENTION

Figure 1:
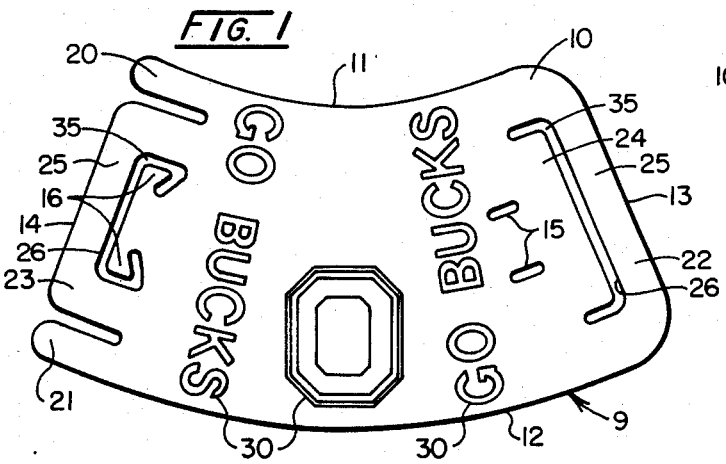
FIG. 1 is a plan view of a blank from which this invention is constructed, in the unassembled condition.

Referring now to FIG. 1, an article 9 of this invention in the unrolled blank conditon, consists of a planar cardlike semirigid flexible material element 10. In the blank development, the material element 10 is shown having opposite and opposing ends 11, 12, and opposite opposing edges 13, 14. Near one edge 13 there is at least one slit 15 and near the other edge 14 there is at least one tab 16. There are also at least one or more other tabs 20, 21. Also located at each edge 13, 14 there are complimentary handle means 22, 23. The handle means 22, 23 include gripping sides 25, 26. Within the handle means 22 there is a flap 24 surrounded by an opening 35.

FIG. 1 also shows the indicia of novelty or display significance 30 printed on the planar surface of the material element 10 of this invention in unassembled form.

Although the article of rolled form could be a tube of uniform diameter along its length, in which case, the edges would be straight; in the preferred embodiment shown in FIGS. 1–4 the article of rolled form is tapered to produce a megaphone effect for the amplification and focus of sound injected in the small end. Therefore, in the unassembled development blank format the ends are not straight.

The ends 11, 12 which have an arcurate generally congruent complimentary curvature about a common center (not shown or indicated). The edges 13, 14 are generally radial from the common center.

Figure 2:
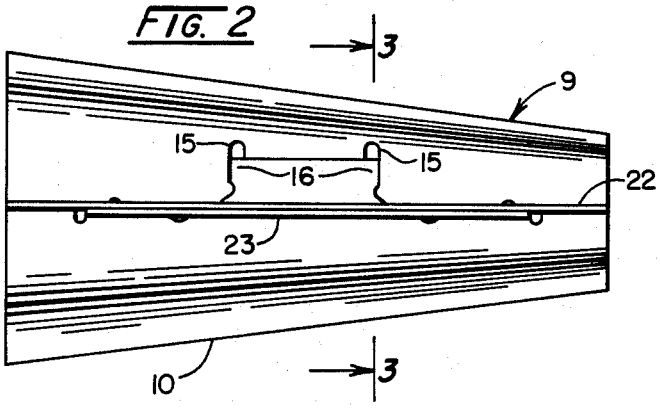
FIG. 2 is a side view of a megaphone of this invention in the assembled condition.
Figure 4:
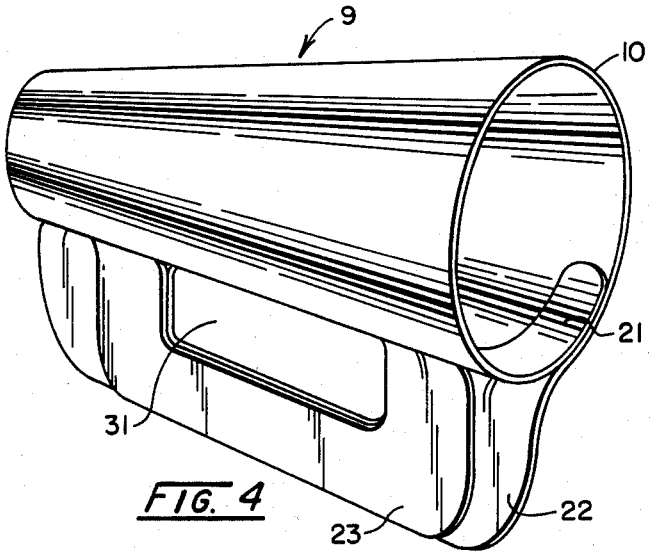
FIG. 4 is a perspective view of a rolled article of this invention in the assembled condition.

When the article of this invention 9 is assembled as shown more clearly in FIG. 4 through rolled construction, it takes on the truncated conical shape, apparent in the side view of FIG. 2, suitable for voice amplification.

Referring now to FIG. 2, the juxtaposition of the complimentary handle means 22, 23 in the assembled form is indicated. At least one tab 16 is inserted in a slit 15 to securely retain the megaphone 9 of this invention in assembled condition. In the embodiment shown, two tabs 15 are provided to mate with two slits 15. Additional tabs and slits could be provided as needed. The semirigidity of the flexible material element 10 serves to maintain a constant pressure upon the tabs 16 within slits 15 to prevent them from working loose.

Figure 3:
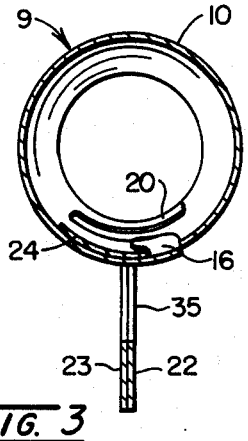
FIG. 3 is a cross sectional view of the megaphone of this invention taken along line 3—3 of FIG. 2.

FIG. 3 represents a cross sectional view along line 3—3 of FIG. 2, showing the two handle means 22, 23 in constant contact and held tightly by tab 16. Another tab 20 is visible within the conical shape of the megaphone 9. It serves to establish and hold the assembled device of this invention in a more truly circular annular cross section. When, in the assembly of this megaphone, the handle means 22, 23 are folded to laterally protrude from a side of the article, flap 24 remains within the confines of the truncated conical megaphone 9 leaving an opening 31 suitable for the insertion of a users hand for gripping.

The tabs 20, 21 in this invention create an important advantage of the article of rolled form in the assembled condition. Each tab 20, 21 lays within the opposite inside surface, forming that inside surface into a circular shape while bending the tab into a mating circular shape and giving the annular cross sectional shape. By this means, the megaphone article of this invention may be assembled in situ at the place of use and it will maintain its annular/circular cross section. In addition to enhancing the appearance, the proper conical truncated shape enhances the function by providing better and more uniform amplification.

Also in addition, the overlapping juxtaposed handle means bear upon one another and by the semirigid flexible nature of the material, add to the rigidity of the assembly at the place where the edges come together.

Figure 5:
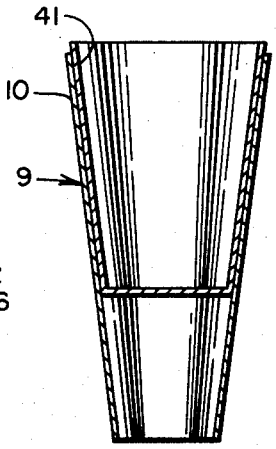
FIG. 5 is a schematic cross sectional view of another embodiment of this invention.

Additional embodiments of the megaphone of this invention have been conceived. Referring to FIG. 5, the material 10 of the megaphone is configured to conform to that of a commonly used styrofoam or paper beverage container. The megaphone is thus tapered from a larger end to a smaller end. The container is placed in the megaphone 9 and the handle 22, 23 is used as a handle for the cup 41. This embodiment is particularly helpful in holding hot beverages when the cup 41 is too hot to hold.

Figure 6:
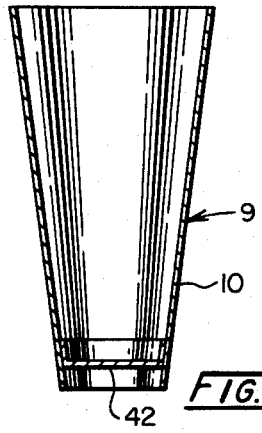
FIG. 6 is schematic cross sectional view of still another embodiment of this invention.

In other instances, a partition insert disk is (see the embodiment of FIG. 6) provided for insertion through the larger end and is wedged in the bottom (smaller end) of the megaphone. This provides a container for popcorn and other granulated food materials at sporting events.

Although a preferred embodiment of the invention has been herein described, it will be understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalence thereof.

I claim:

1. An article of rolled form comprising:

(a) a planar card like semi-rigid material means having opposite and opposing ends and opposite and opposing edges with at least one slit near one edge and at least one tab near the other edge, and one or more other tabs on each edge near each end, with each edge having complimentary handle means cut from the material element; and (b) having a rolled construction at assembly of circular cross sectional shape between the ends with the edges overlapped and the at least one tab engaged in the at least one slit to retain the article in assembly, with one or more tab on each end inserted within the roll of the other end to restrain the article in generally circular cross sectional shape, each handle means being folded to laterally protrude from a side of the article and to press against the other handle.

2. An article according to claim 1 wherein indicia of novelty or display significance is imprinted upon at least one side of the material means, and the indicia is legibly visable from the outside of the article.

3. A article according to claim 1 wherein the ends are of arcuate generally congruent complimentary curvature about a generally common center, and the edges are generally radial from the common center, said article forming a megaphone structure.

4. A megaphone according to claim 3 wherein:

the one or more tabs on each end is parallel to the shape of the end, at the intersection of the end and an edge, and comprises a rolled circular portion conforming to the circular cross sectional form of the end.

5. A megaphone in accordance with claim 3 having a tapered figuration from a larger end to a smaller end, in combination with a beverage container of conforming taper, inserted within the large end of the megaphone.

6. A megaphone according to claim 3, having a tapered configuration from a larger end to a smaller end, including in combination a partition inserted through the large end and wedged in the taper of the megaphone to serve as a bottom of the container formed by the combination.

* * * * *